US010343433B2

(12) United States Patent
Liu et al.

(10) Patent No.: US 10,343,433 B2
(45) Date of Patent: Jul. 9, 2019

(54) SKEW SENSOR CALIBRATION

(71) Applicant: Hewlett-Packard Development Company, L.P., Houston, TX (US)

(72) Inventors: Hsue-Yang Liu, Vancouver, WA (US); Luke P. Sosnowski, Vancouver, WA (US); Mark H. Mackenzie, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,879

(22) PCT Filed: Oct. 30, 2015

(86) PCT No.: PCT/US2015/058514

§ 371 (c)(1),
(2) Date: Jan. 30, 2018

(87) PCT Pub. No.: WO2017/074470

PCT Pub. Date: May 4, 2017

(65) Prior Publication Data

US 2018/0222231 A1 Aug. 9, 2018

(51) Int. Cl.
*B41J 29/38* (2006.01)
*B41J 2/175* (2006.01)
(Continued)

(52) U.S. Cl.
CPC ..... *B41J 29/38* (2013.01); *B41J 2/175* (2013.01); *B41J 11/0095* (2013.01); *B41J 13/0009* (2013.01); *B41J 13/03* (2013.01)

(58) Field of Classification Search
CPC ..... B41J 29/38; B41J 13/03; B41J 13/0009; B41J 2/175; B41J 11/0095
See application file for complete search history.

(56) References Cited

U.S. PATENT DOCUMENTS 7,630,653 B2 12/2009 Bonino
8,075,086 B2 12/2011 Mizes
(Continued)

FOREIGN PATENT DOCUMENTS

JP 2007060516 3/2007
JP 2007060516 A * 3/2007
(Continued)

OTHER PUBLICATIONS

Machine Translation of Image Photographing System and Image Forming Device (JP 2007060516 A), Mar. 8, 2007, Fuji Xerox, Paragraphs 0001, 0005, 0007, 0043-0044, and 0054-0062 (Year: 2007).*

(Continued)

*Primary Examiner* — Lisa Solomon
(74) *Attorney, Agent, or Firm* — HP Inc. Patent Department

(57) ABSTRACT

A skew sensor calibration unit including a scanner providing a scanned image of a sheet as the sheet is conveyed along a transport path, the scanned image including a leading edge of the sheet and a skew detection pattern printed thereon by a printhead. A calibration module measures a top skew of the sheet based on position signals from a plurality of skew sensors indicating a position of a leading edge of a sheet as the sheet is conveyed along the transport path, measure an image skew of the sheet relative to the printhead based on the scanned image, and generates a calibration factor that when applied to the measured top skew provides a calibrated top skew that matches the image skew.

15 Claims, 8 Drawing Sheets

(51) Int. Cl.

| | |
|---|---|
| ***B41J 11/00*** | (2006.01) |
| ***B41J 13/00*** | (2006.01) |
| ***B41J 13/03*** | (2006.01) |

(56) References Cited

U.S. PATENT DOCUMENTS

| | | | |
|---|---|---|---|
| 8,649,052 | B2 | 2/2014 | Hoover et al. |
| 2006/0017802 | A1 | 1/2006 | Yoo et al. |
| 2010/0047000 | A1 | 2/2010 | Park et al. |
| 2011/0277604 | A1 | 11/2011 | Yahata et al. |
| 2012/0133093 | A1 | 5/2012 | Saito |
| 2012/0251132 | A1 | 10/2012 | Bonino et al. |
| 2012/0327168 | A1 | 12/2012 | Bouverie et al. |
| 2013/0026706 | A1 | 1/2013 | Hirota et al. |

FOREIGN PATENT DOCUMENTS

| | | |
|---|---|---|
| JP | 2009039952 | 2/2009 |
| JP | 2013028135 | 2/2013 |

OTHER PUBLICATIONS

IP.com search (Year: 2018).*

International Searching Authority, "Search Report," issued in connection with PCT Paten application No. PCT/US2015/058514, dated Jul. 20, 2016, 5 pages.

International Searching Authority, "Written Opinion," issued in connection with PCT Paten application No. PCT/US2015/058514, dated Jul. 20, 2016, 10 pages.

* cited by examiner

SKEW SENSOR CALIBRATION

BACKGROUND

Imaging devices, such as an inkjet printers, for example, typically convey a sheet of imaging media along a transport path to an image forming section, such as an inkjet printhead, which forms a desired image on the sheet. In some instances, the sheet may be skewed such that that a leading edge of the sheet is non-orthogonal to a conveyance direction of the sheet along the transport path.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Imaging devices, such as inkjet printers, for example, convey sheets of imaging media along a transport path from a sheet supply (e.g. a cassette) to an image forming section, such as an inkjet printhead, which forms desired images (e.g. text, characters, etc.) on the sheets. As the sheets are conveyed along the transport path, which is typically formed by pairs of conveyance rollers, the sheets may be skewed such that the leading edges of the sheets are non-orthogonal to a conveyance or process direction of the sheets along the transport path. If such skew (also referred to as "top skew") is not corrected prior to image formation, the desired image formed by the image forming section will be displaced or skewed relative to sheet.

Printers generally employ a dynamic skew correction system to physically reposition the sheets as they move along the transport path so that the leading edges are orthogonal to the process direction (i.e. "deskew" the sheets). Such skew correction systems typically employ skew sensors spaced across the transport path in a direction orthogonal to the process direction. The skew sensors detect the leading edge of the sheet and, based on a known conveyance speed of the sheet and a known spacing between the skew sensors, a top skew of the sheet is determined. Based on the measured top skew, the skew correction systems employs a deskew mechanism to deskew the sheet prior to the sheet reaching the image forming section.

However, due to mechanical tolerances in placement of the skew sensors (e.g., non-orthogonal to the transport path, not be spaced paced apart by a desired distance, non-parallel with the printhead), and because skew sensor operation may degrade over time (including differentially over time), skew measurements made by the skew sensors may be inaccurate and become more so over time.

Figure 1:
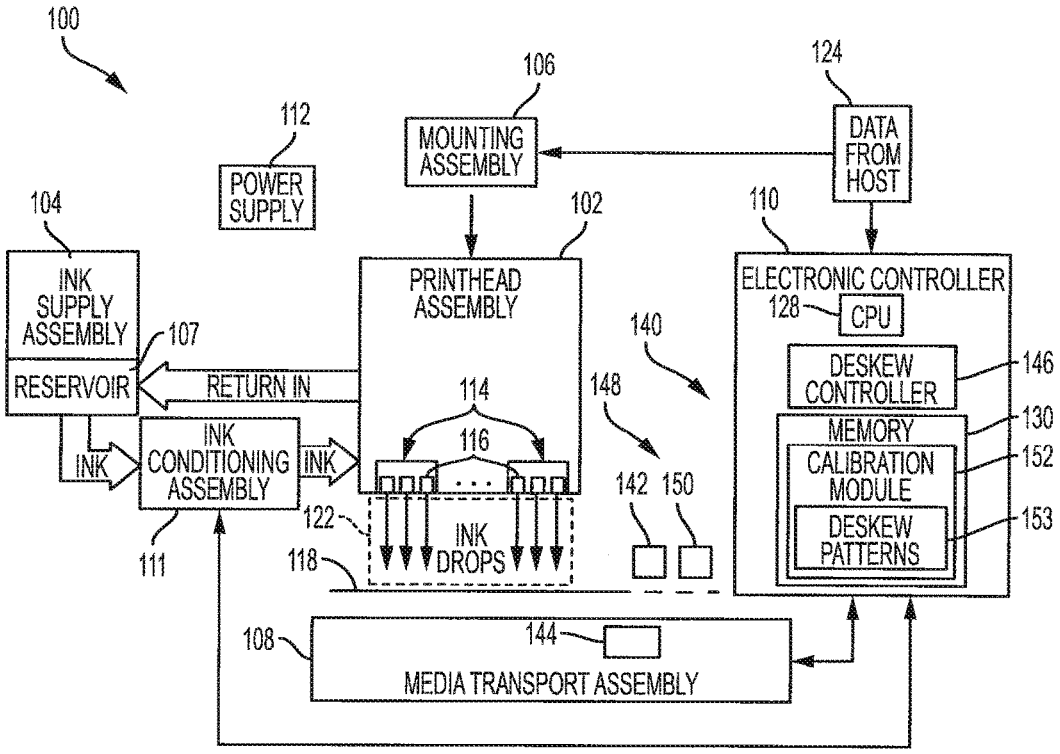
FIG. 1 is a block and schematic diagram generally illustrating an inkjet printing system including a skew sensor calibration unit according to one example.

FIG. 1 is a block and schematic diagram generally illustrating an inkjet printing system 100 employing skew sensors (e.g. optical skew sensors) for measuring sheet skew and including a skew sensor calibration unit, in accordance with the present disclosure. As will be described in greater detail herein, in accordance with the present disclosure, the skew sensor calibration unit employs a scanner for calibrating the skew sensors, both at manufacture and during operation (based on user initiation, for example), to provide and maintain accurate skew measurements for the deskewing of sheets of print media. According to one example, as will be described in greater detail herein, the scanbar scans a sheet of imaging media having a skew detection pattern printed thereon. From the scanned image, a calibration factor is determined for calibrating the skew sensors so that accurate skew measurements can be made and enable a skew correction unit to accurately align a leading edge of the sheet with a printhead of inkjet printing system 100.

Inkjet printing system 100 includes an inkjet printhead assembly 102, an ink supply assembly 104 including an ink storage reservoir 107, a mounting assembly 106, a media transport assembly 108, an electronic controller 110, and at least one power supply 112 that provides power to the various electrical components of inkjet printing system 100.

Inkjet printhead assembly 102 includes one or more printhead dies 114, each of which ejects drops of ink through a plurality of orifices or nozzles 116 toward sheet 118 so as to print onto sheet 118. In one example, inkjet printhead assembly 102 is a wide array printhead having a plurality of printhead dies 114. With properly sequenced ejections of ink drops, nozzles 116, which are typically arranged in one or more columns or arrays, produce characters, symbols or other graphics or images to be printed on sheet 118 as inkjet printhead assembly 102 and sheet 118 are moved relative to each other.

In operation, ink typically flows from reservoir 107 to inkjet printhead assembly 102, with ink supply assembly 104 and inkjet printhead assembly 102 forming either a one-way ink delivery system or a recirculating ink delivery system. In a one-way ink delivery system, all of the ink supplied to inkjet printhead assembly 102 is consumed during printing. However, in a recirculating ink delivery system, only a portion of the ink supplied to printhead assembly 102 is consumed during printing, with ink not consumed during printing being returned to supply assembly 104. Reservoir 107 may be removed, replaced, and/or refilled.

In one example, ink supply assembly 104 supplies ink under positive pressure through an ink conditioning assembly 111 to inkjet printhead assembly 102 via an interface connection, such as a supply tube. Ink supply assembly includes, for example, a reservoir, pumps, and pressure regulators. Conditioning in the ink conditioning assembly may include filtering, pre-heating, pressure surge absorption, and degassing, for example. Ink is drawn under negative pressure from printhead assembly 102 to the ink supply assembly 104. The pressure difference between an inlet and an outlet to printhead assembly 102 is selected to achieve correct backpressure at nozzles 116.

Mounting assembly 106 positions inkjet printhead assembly 102 relative to media transport assembly 108, and media transport assembly 108 positions sheet 118 relative to inkjet printhead assembly 102, so that a print zone 122 is defined adjacent to nozzles 116 in an area between inkjet printhead assembly 102 and sheet 118. In one example, inkjet printhead assembly 102 is scanning type printhead assembly. According to such example, mounting assembly 106 includes a carriage for moving inkjet printhead assembly 102 relative to media transport assembly 108 so as to scan printhead dies 114 across sheet 118 as media transport assembly moves sheet 118 relative to printhead assembly 102.

In another example, inkjet printhead assembly 102 is a non-scanning type, page-wide array (PWA) printhead assembly including a plurality of printhead dies 114 positioned laterally such that printhead assembly 102 forms a printbar extending laterally across sheet 118. According to such example, mounting assembly 106 maintains inkjet printhead assembly 102 at a fixed position relative to media transport assembly 108, with media transport assembly 108 moving sheet 118 relative to stationary inkjet printhead assembly 102.

Electronic controller 110 includes a processor (CPU) 128, a memory 130, firmware, software, and other electronics for communicating with and controlling inkjet printhead assembly 102, mounting assembly 106, and media transport assembly 108. Memory 130 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for inkjet printing system 100.

Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters. In one implementation, electronic controller 110 controls inkjet printhead assembly 102 for the ejection of ink drops from nozzles 116 of printhead dies 114. Electronic controller 110 defines a pattern of ejected ink drops to form characters, symbols, and/or other graphics or images on sheet 118 based on the print job commands and/or command parameters from data 124.

According to one example, inkjet printing system 100 includes a skew correction unit 140 including skew sensors 142, a deskew mechanism 144, and a deskew controller 146. In one example, as illustrated, deskew mechanism 144 is implemented as part of transport assembly 108 for conveyance of sheet 118. In one example, according to the present disclosure, as will be described in greater detail below, skew correction unit 140 includes a calibration unit 148 including a scanner 150 and calibration module 152 which, according to one example, is stored in memory 130 and includes instructions, that when executed by processor 128, determines a calibration factor for calibrating skew sensors 142 based on based on position signals from skew sensors 142 and an image of sheet 118 from scanner 150.

Figure 2:
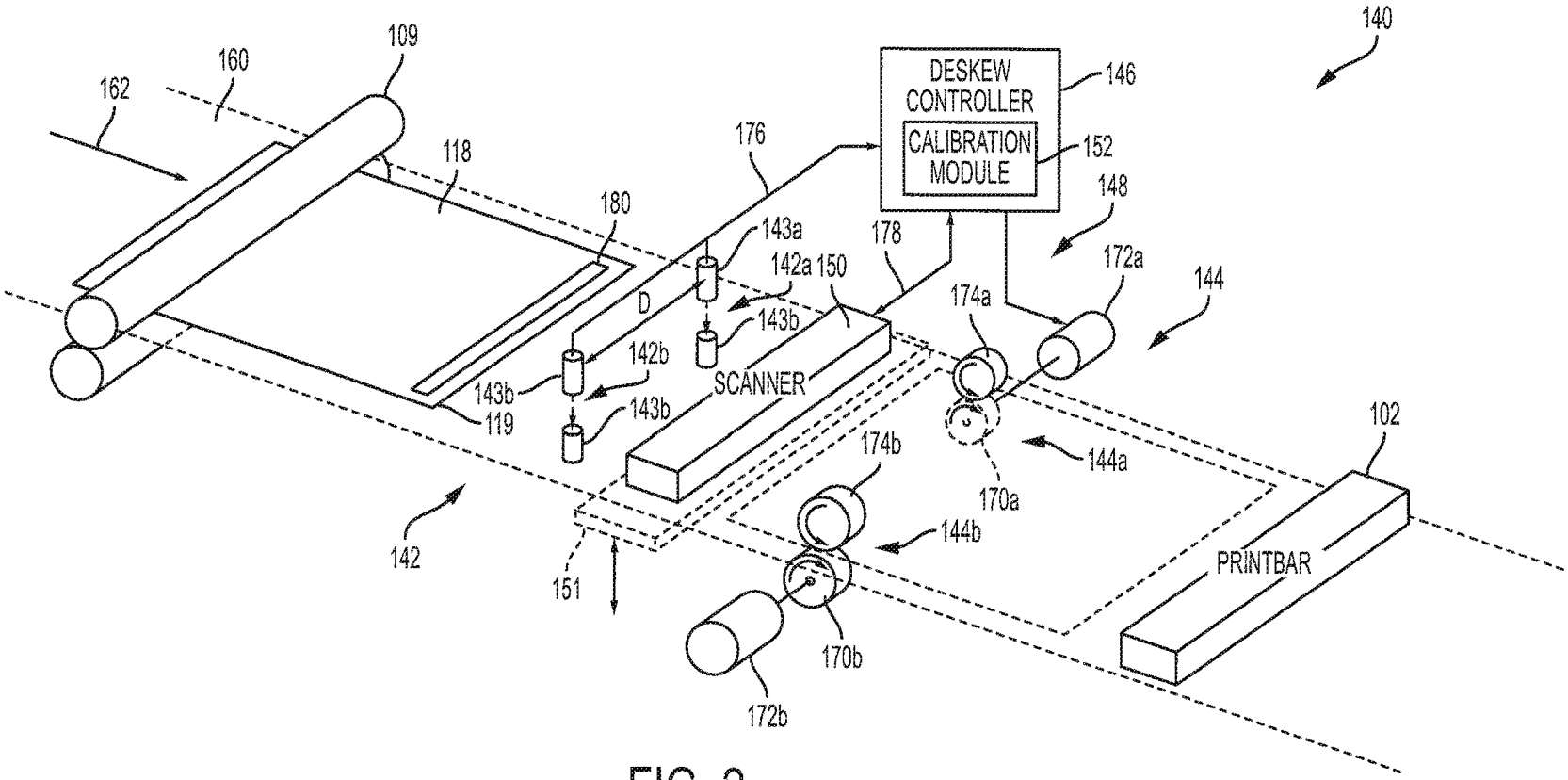
FIG. 2 is a block and schematic diagram illustrating a skew correction system including a skew sensor calibration unit according to one example.

FIG. 2 is a block and schematic diagram illustrating an example of skew correction unit 140, including calibration unit 148 in accordance with the present disclosure, for measuring and correcting top skew of sheet 118 as it is conveyed along a transport path 160 in a transport or process direction 162 by transport assembly 108 to a printhead 102 for the printing of an image thereon. In one example, transport assembly 108 includes a plurality of conveyance roller pairs for conveying sheet 118 along transport path 160, such as conveyance roller pair 109. In one example, as illustrated, printhead 102 is implemented as a page wide array (PWA) inkjet printhead 102.

In one example, skew correction unit 140 includes skew sensors 142, a deskew mechanism 144, and a deskew controller 146, with skew sensors 142 being positioned upstream of deskew mechanism 144 relative to process direction 162. In one example, skew sensors 142 are implemented as a pair of optical sensors 142*a* and 142*b*, each including a light emitter 143*a* and a light receiver 143*b* positioned opposite one another across transport path 160. In other examples, more than two optical sensors may be employed. In one example, optical sensors 142*a*, 142*b* disposed orthogonally across transport path 160 (i.e. orthogonal to process direction 162) and spaced apart by a known distance, D.

In one example, deskew mechanism 144 is implemented as two sets of skew correction rollers 144*a* and 144*b* spaced apart from one another by a predetermined distance across transport path 160. Each set of skew correction rollers 144*a*, 144*b* includes a driven roller 170 (illustrated as driven rollers 170*a* and 170*b*) driven by a drive motor 172 (illustrated as drive motors 172*a* and 172*b*), such as a stepper motor, for example, and an idler roller 174 (illustrated as idler motors 174*a* and 174*b*) forming a pinch with the corresponding driven roller 170 for conveying sheet 118 along transport path 160. While skew correction rollers 144*a* and 144*b* are illustrated as being part of media transport assembly 108 and assist in conveying sheet 118 along transport path 160, in other examples, deskew mechanism 144 may be separate from media transport assembly 108.

In operation, sheet 118 is conveyed in the process direction 162 along transport path 160 at a known conveying speed by transport assembly 108. As a leading edge 119 of the sheet 118 passes the positions at which light sensors 142*a* and 142*b* are disposed, light from their respective light emitter 143*a* is blocked from reaching light receiver 143*b* by sheet 118, thereby indicating the presence of the leading edge 119. Position signals from optical sensors 142*a* and 142*b* indicative of the presence/absence of sheet 118 are provided to deskew controller 146 via a communications path 176. In one example, based on the known distance D between skew sensors 142*a* and 142*b*, the known conveyance speed of sheet 118 along transport path 160, and a time difference (Δt) between when leading edge 119 of sheet 118 passes skew sensors 142*a* and 142*b*, deskew controller 146 determines a top skew, $S_T$, of sheet 118. For example, sheet 118 may be skewed such that leading edge 119 reaches the position of skew sensor 142*a* prior to reaching the position of skew sensor 142*b* (i.e. sheet is skewed in a clockwise direction relative to FIG. 2).

Based on the measured $S_T$ from skew sensors 142, when sheet 118 reaches skew correction rollers 144*a* and 144*b*, deskew controller 146 drives skew correction rollers 144*a* and 144*b* at different speeds (via control of drive motors 172*a*, 172*b*) to deskew sheet 118. For example, if the leading edge 119 reaches skew sensor 142*a* before reaching skew sensor 142*b*, deskew controller 146 may drive skew correction roller set 144*b* at the desired conveyance speed while driving skew correction roller set 144*a* at a slow speed for a determined duration, thereby turning sheet 118 in a counter-clockwise to correct the measured skew, $S_T$. Once the skew has been corrected, deskew controller 146 controls drives both pairs of skew correction roller 144*a*, 144*a* at the desired conveyance speed so that the now deskewed sheet 118 is transported at the desired conveyance speed past printhead 102 (PWA printbar 102 in the illustrated example of FIG. 2).

However, as described above, due to mechanical tolerances and degradation of sensor response over time, skew sensors 142 may provide position signals to deskew controller 146 that do not accurately represent the true position of leading edge 119 of sheet 118. As a result, deskew controller 146 will be unable to accurately measure the top skew $S_T$ and, thus, be unable to accurately deskew sheet 118. According to one example, both at manufacture of inkjet printing system 100 and during operation thereafter (such as upon user initiation, for example), calibration unit 148 determines a calibration factor which is applied by deskew controller 146 to $S_T$ measurements based on skew sensors 142 to generate a calibrated or corrected skew measurement, $S_{TC}$, that eliminates skew sensor inaccuracies. The corrected skew measurement $S_{TC}$ is then used by deskew controller 146 to control deskew mechanism 144 (e.g., deskew roller pairs 144*a*, 144*b*) to deskew sheet 118 so that the leading edge 119 is aligned with printhead 102 (e.g., printbar 102).

An example of the operation of calibration unit 148 is described below. Initially, transport assembly 108 conveys sheet 118 to printbar 102 and is deskewed by deskew roller pairs 144*a*, 144*b* based on measured $S_T$ as described above. As sheet 118 is transported past printbar 102, a selected deskew pattern 180 is printed on sheet 118 by printbar 102 so that sheet 118 forms a calibration sheet. In one example, calibration module 152 includes one or more predetermined deskew patterns 153 (see FIG. 1) which may be selected by calibration module 152 for printing by printbar 102. Transport assembly then returns sheet 118 to a position where leading edge 119 is upstream of deskew sensors 142*a*, 142*b* as illustrated by the position of sheet 118 in FIG. 2 (e.g., by temporarily reversing the conveyance direction of sheet 118 along transport path 160). Once repositioned upstream of skew sensors 144*a*, 144*b*, transport assembly 108 returns to conveying sheet 118 in process direction 162.

As sheet 118 moves along transport path 160, skew sensors 142*a*, 142*b* detect leading edge 119 and provide, via a communication path 176, position signals to calibration module 152. As sheet 118 continues to be conveyed along transport path 160 by media transport assembly 108, scanner 150 provides a scanned image of sheet 118, the scanned image including the leading edge 119 and skew detection pattern 180, with the scanned image being provided to calibration module 152 via a communication path 178. In one example, a bias shoe 151 is moveable between a biased and unbiased position, and positions sheet 118 at a known position proximate to scanner 150 when in the biased position.

According to one example, as will be described in greater detail below, calibration module 152 determines a top skew ($S_T$) of leading edge 119 based on the position signals from skew sensors 142, determines a print skew ($S_P$) of the sheet based the scanned image from scanner 150, and generates a calibration factor (CF) therefrom that when applied to the top skew $S_T$ adjusts, or calibrates, the top skew $S_T$ to provide a calibrated skew $S_{TC}$ that matches the print skew $S_P$. Thereafter, or until another calibration factor is determined, deskew controller 146 applies the calibration factor to the top skew $S_T$ determined from skew sensors 142 to generate an adjusted or calibrated skew $S_{TC}$ and controls deskew mechanism 144 to deskew sheet 118 based on the calibrated skew $S_{TC}$.

It is noted that the hardware arrangement illustrated by FIG. 2 represents only one example of a hardware arrangement that could be employed for skew correction unit 140. In other examples, the hardware could be ordered differently. For instance, in one example, skews sensors 142*a*, 142*b* could be disposed between deskew roller pairs 144*a*, 144*b* and printbar 102.

Figure 3A:
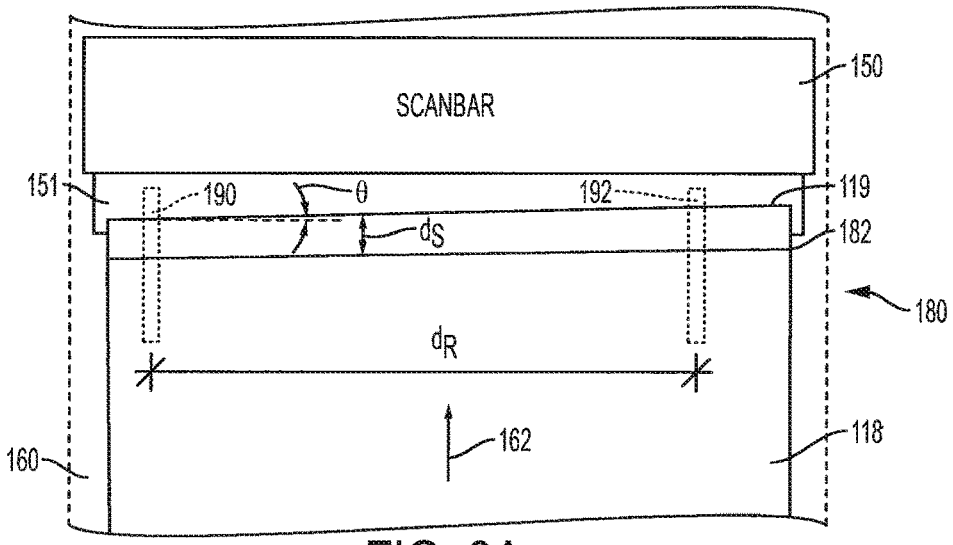
FIG. 3A is block and schematic diagram generally illustrating portions of a skew sensor calibration unit including a calibration page according to one example.
Figure 3B:
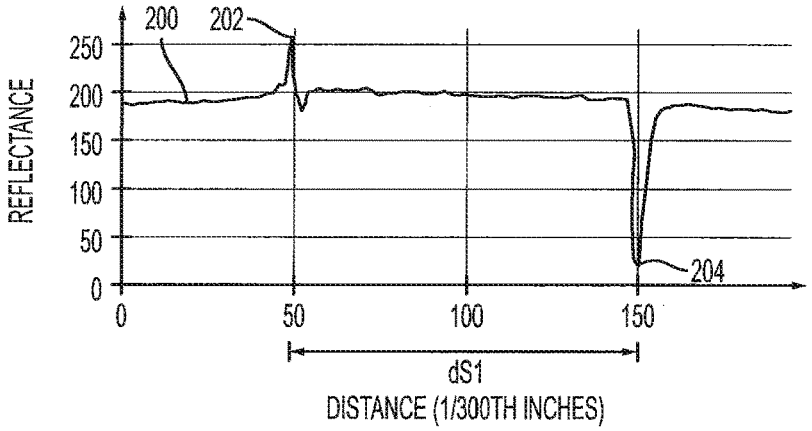
FIG. 3B is a graph is graph of pixel values from a scanned image of a calibration page according to one example.
Figure 3C:
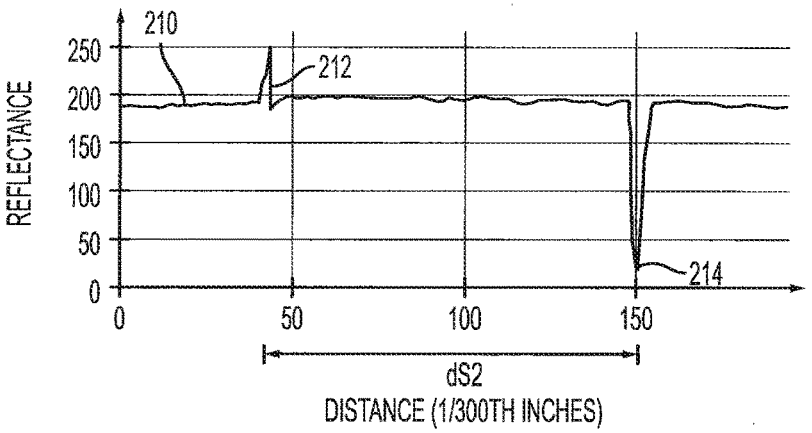
FIG. 3C is a graph is graph of pixel values from a scanned image of a calibration page according to one example.

FIGS. 3A-C below generally illustrate examples of the operation of calibration unit 148 in determining a skew calibration factor CF for skew sensors 142 from leading edge 119 position signals provided by skew sensors 142 and from a scanned image of sheet 118 including deskew pattern 180.

FIG. 3A-3C generally illustrate the operation of calibration unit 148 according to one example. FIG. 3A is top, or plan, view illustrating portions of skew correction unit 140 of FIG. 2. In the example of FIG. 3A, skew detection pattern 180 is a line 182 printed across sheet 118 in a direction lateral to process direction 162 and spaced from leading edge 119. To determine print skew $S_P$ of sheet 118, scanner 150 scans an image of sheet 118 as it passes on transport path 160 and provides the scanned image to calibration module 152 via a communications path 178, the scanned image including leading edge 119 and skew detection pattern 180 which, in this example, is line 182. In one example, scanner 150 is at a fixed position and includes a single row of pixels extending laterally across transport path 160.

Calibration module 152 analyzes pixel data from scanned image at locations corresponding to at least two regions of interest (ROI), such as ROI 190 and 192 (illustrated by dashed boxes in FIG. 3A), to determine a distance, $d_S$, from leading edge 119 to line 182. Each of the ROIs, in this case ROI 190 and 192, are at a known distance from another, such as distance $d_R$ between ROI 190 and ROI 192 (e.g, based on known spacing between pixels of scanner 150). Based on the distances $d_S$ determined at ROI 190 and 192, and on the known distance $d_R$ between ROI 190 and 192, calibration module 152 determines the print skew $S_P$ of sheet 118 (e.g., illustrated as skew angle θ in FIG. 3A). In one example, ROI 190 and 190 correspond respectively to the lateral positions of skew sensors 142*a* and 142*b*. In other examples, image data from more than two regions of interest are analyzed, such as 25 regions of interest, for example.

FIGS. 3B and 3C are graphs illustrating examples of measured pixel values (e.g., values from 0-255) of scanner 150 at ROIs 190 and 192, where pixel values represent light reflectance from transport path 160. In one example, pixel values for each ROI are from a single pixel of scanner 150. In one example, the pixel values are an average value of a plurality of adjacent pixels of scanner 150 corresponding to each ROI. In the graphs of FIGS. 3B and 3C, pixel values (or average pixel values) are indicated on the y-axis and distance is indicated on the x-axis. According to one example, as illustrated by FIGS. 3B and 3C, scanner 150 has a resolution of 300 dots-per-inch (dpi), with the x-axis being in units of 1/300 inches.

In the example of FIGS. 3A-3C, it is noted that bias shoe 151 is in the biased position so as to be extended toward scanner 150. With reference to FIG. 3B, a portion of the graph from zero to approximately $50/300^{ths}$ inches, as indicated at 200, represents reflectance values from bias shoe 151 prior to leading edge 119 of sheet 118 reaching scanner 150. A spike in pixel values at approximately $50/300^{ths}$ inches, as indicated at 202, represents a change in reflectance due to the presence of leading edge 119. A drop in pixel values at approximately $150/300^{ths}$ inches, as indicated 204, represents a change in reflectance due to the presence of line 182 of skew detection pattern 180. A distance $d_{S1}$ between the reflectance spike at 202 and the drop in reflectance at 204 represents the distance $d_S$ between the leading edge 119 and line 182 at ROI 190.

Similarly, with reference to FIG. 3C, a portion of the graph indicated at 210, represents reflectance values from bias shoe 151 prior to leading edge 119 of sheet 118 reaching scanner 150. A spike in pixel values at 212 represents a change in reflectance due to the presence of leading edge 119 of sheet 118. A drop in pixel values at 214 represents a change in reflectance due to the presence of line 182 of skew detection pattern 180. A distance $d_{S2}$ between the reflectance spike at 212 and the drop in reflectance at 214 represents the distance $d_S$ between the leading edge 119 and line 182 at ROI 192.

Based on the determined distances $d_{S1}$, $d_{S2}$ and the predetermined distance $d_R$ between ROI 190 and ROI 192, calibration module 152 determines the print skew $S_P$ (i.e., skew determined from scanned image) of sheet 118 relative to printhead 102. Additionally, based on top skew measurement $S_T$ from position signals of skew sensors 142, calibration module 152 determines a calibration factor, CF, such that when the calibration factor is applied to top skew measurement $S_T$ by skew sensors 142, a corrected top skew measurement $S_{TC}$ is generated, where $S_{TC}$ is equal to print skew measurement $S_P$ determined from the scanned image. As described above, deskew controller 146 thereafter applies the calibration factor to top skew measurements $S_T$ from skew sensors 142 to generate calibrated skew measurements $S_{TC}$. Deskew controller 146 then employs calibrated skew measurements $S_{TC}$ to control deskew mechanism 144 to correct the skew of sheets 118.

Figure 4A:
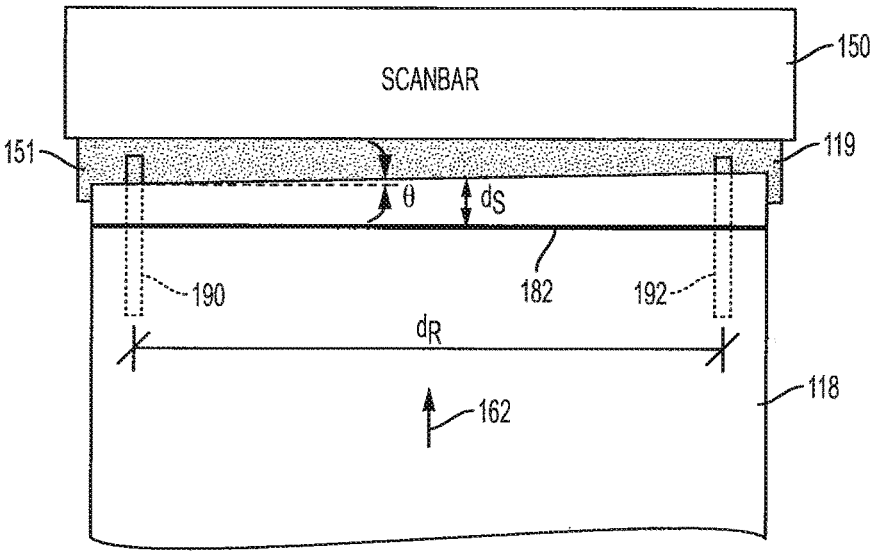
FIG. 4A is a block and schematic diagram generally illustrating portions of a skew sensor calibration unit including a calibration page according to one example.

The transition from bias shoe 151 to the leading edge 119 of sheet 118 when bias shoe 151 is in the extended or biased position, as respectively indicated at 202 and 212 in FIGS. 3B and 3C, may be difficult to detect. In one example, as illustrated by FIGS. 4A-4C, the contrast between bias shoe 151 and sheet 118 when scanning sheet 118 is increased by positioning bias shoe 151 in the unbiased position away from scanner 150, thereby making leading edge 119 of sheet 118 easier to detect.

Figure 4B:
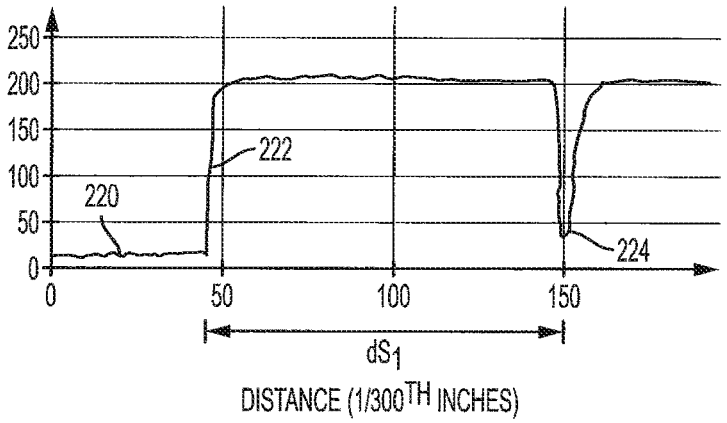
FIG. 4B is a graph is graph of pixel values from a scanned image of a calibration page according to one example.

With reference to FIG. 4B, a portion of the graph at 220 represents reflectance values from bias shoe 151 (in the retracted position) prior to sheet 118 reaching scanner 150. A spike in pixel values at 222, represents a change in reflectance due to the presence of leading edge 119. A drop in pixel values at indicated 224, represents a change in reflectance due to the presence of line 182 of skew detection pattern 180. A distance $d_{S1}$ between the reflectance spike at 222 and the drop in reflectance at 224 represents the distance $d_S$ between the leading edge 119 and line 182 at ROI 190.

Figure 4C:
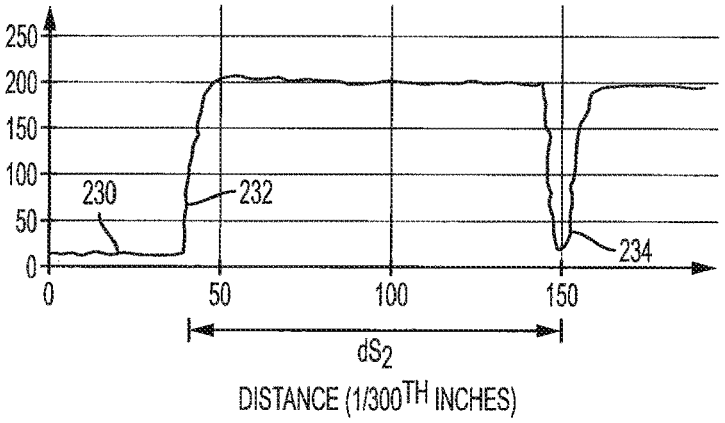
FIG. 4C is a graph is graph of pixel values from a scanned image of a calibration page according to one example.

Similarly, with reference to FIG. 4C, a portion of the graph at 230, represents reflectance values from bias shoe 151 (in the retracted position) prior to sheet 118 reaching scanner 150. A spike in pixel values at 232 represents a change in reflectance due to the presence of leading edge 119 of sheet 118. A drop in pixel values at 234 represents a change in reflectance due to the presence of line 182 of skew detection pattern 180. A distance $d_{S2}$ between the reflectance spike at 232 and the drop in reflectance at 234 represents the distance $d_S$ between the leading edge 119 and line 182 at ROI 192.

As before, calibration module 152 determines the print skew measurement $S_P$ of sheet 118 relative to printhead 102 based on the determined distances $d_{S1}$, $d_{S2}$ and the known distance $d_R$ between ROI 190 and ROI 192. Additionally, based on a top skew measurement $S_T$ based on position signals from skew sensors 142, calibration module 152 determines the calibration factor, CF, that when applied to top skew measurement $S_T$ generates the corrected $S_{TC}$ that is equal to print skew measurement $S_P$ determined from the scanned image. As described above, deskew controller 146 thereafter applies the calibration factor CF to top skew measurements $S_T$ based on skew sensors 142 to generate calibrated skew measurements $S_{TC}$. Deskew controller 146 then employs the calibrated skew measurements $S_{TC}$ to control deskew mechanism 144 to correct the skew of sheets 118.

Figure 5A:
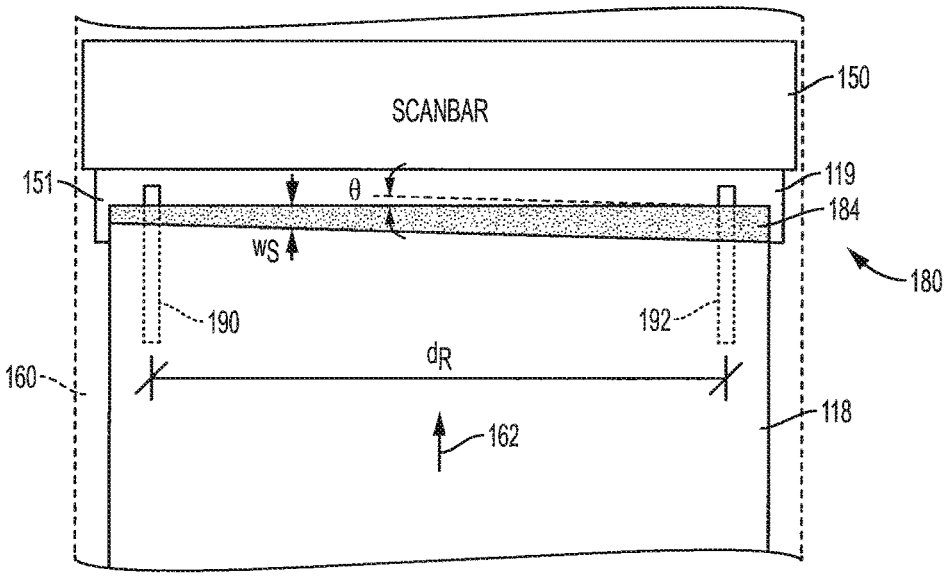
FIG. 5A is a block and schematic diagram generally illustrating portions of a skew sensor calibration unit including a calibration page according to one example.
Figure 5B:
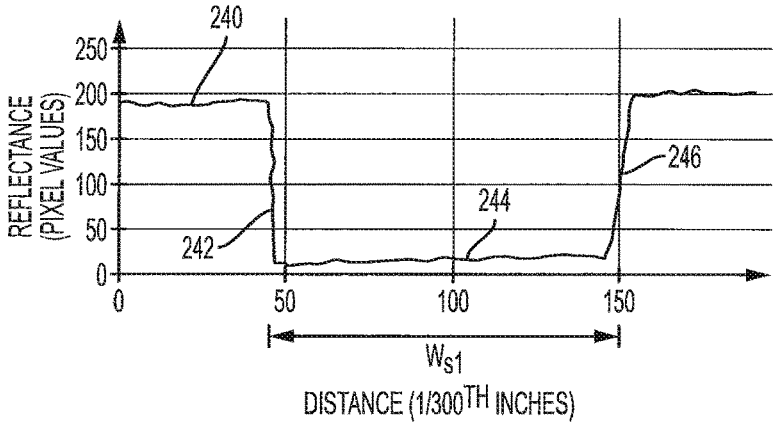
FIG. 5B is a graph is graph of pixel values from a scanned image of a calibration page according to one example.
Figure 5C:
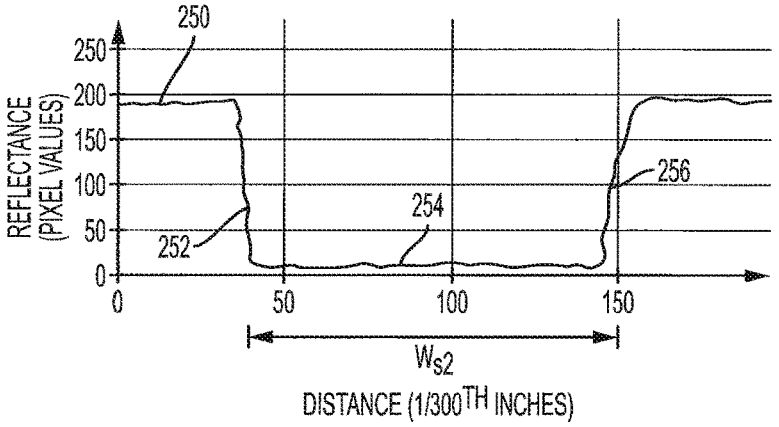
FIG. 5C is a graph is graph of pixel values from a scanned image of a calibration page according to one example.

According to one example, as illustrated by FIGS. 5A-5C, skew detection pattern 180 is a wide bar 184 printed on sheet 118 along leading edge 119. With bias plate 151 in the biased position, printed bar 184 provides a high degree of contrast between bias plate 151 and leading edge 119 of sheet 118. To determine the print skew $S_P$ of sheet 118, calibration module 152 determines the width, $W_S$, of printed bar 184 from the scanned image provided by scanner 150 from pixel data at least at ROI 190 and ROI 192. In the example of FIGS. 5A-5C, a leading edge of printed bar 184 coincides with leading edge 119 of sheet 118, providing improved contrast thereto, particularly with bias plate 151 extended in a bias position, with a trailing edge of printed bar 184 functioning similarly to line 182 as described above by FIGS. 3A-4C.

With reference to FIG. 5B, a portion of the graph at 240 represents reflectance values from bias shoe 151 (in the extended position) prior to sheet 118 reaching scanner 150. A decrease in pixel values at 242 represents a change in reflectance due to leading edge 119 and, thus, bar 184 reaching scanner 150. A portion of the graph at 244 represents the reflectance of bar 184. A rise in pixel values at 246 represents the edge of bar 184. A distance between the drop in pixel values at 242 and the rise in pixel values at 246 represents the width $w_{S1}$ of printed bar 184 at ROI 190.

Similarly, with reference to FIG. 5C, a portion of the graph at 250 represents reflectance values from bias shoe 151 (in the extended position) prior to sheet 118 reaching scanner 150. A decrease in pixel values at 252 represents a change in reflectance due to leading edge 119 and, thus, printed bar 184 reaching scanner 150. A portion of the graph at 254 represents the reflectance of printed bar 184. A rise in pixel values at 256 represents the edge of bar 184. A distance between the drop in pixel values at 252 and the rise in pixel values at 256 represents the width $w_{S2}$ of printed bar 184 at ROI 192.

As described above, calibration module 152 determines the print skew $S_P$ (i.e., from the scanned image) of sheet 118 relative to printhead 102 based on the determined widths $w_{S1}$, $w_{S2}$ and the predetermined distance $d_R$ between ROI 190 and ROI 192. Further, based on top skew measurement $S_T$ from skew sensors 142, calibration module 152 determines the calibration factor, CF. Thereafter, as described above, deskew controller 146 thereafter applies the calibration factor to top skew measurements $S_T$ from skew sensors 142 to generate calibrated skew measurements $S_{TC}$. Deskew controller 146 subsequently employs the calibrated skew measurements $S_{TC}$ to control deskew mechanism 144 to correct the skew of sheets 118.

Figure 6:
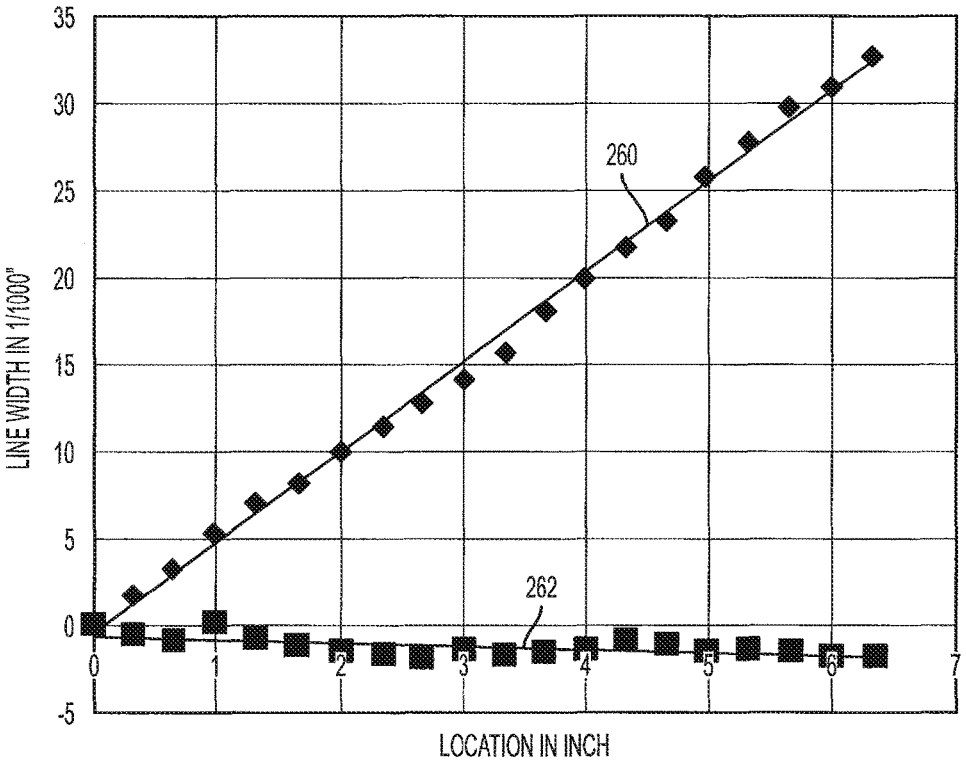
FIG. 6 is graph illustrating skew measurements according to one example.

FIG. 6 is a graph illustrating examples of width measurement $W_S$ of printed bar 184 of FIG. 5A as measured from scanned images provided by scanner 150 to calibration unit 152. Although described above as being measured in only two regions of interest 190, 192, according to example of FIG. 6, the width $W_S$ is measured at twenty regions of interest across a width of sheet 118. In FIG. 6, the x-axis represents the location in inches across the width of sheet 118 in a direction normal to processing direction 162, and the y-axis represents the width $W_S$ of printed bar 184 in $1/1000^{th}$ of an inch. FIG. 6 illustrates examples of sheet 118 having two different top skews, with curve 260 representing sheet 118 with a higher degree of top skew and curve 262 representing sheet 118 with a lower degree of top skew. For each curve, each of the boxes represent individual width measurements $W_S$ at each of the twenty regions of interest. According to one example, curves 260 and 262 are determined from the individual width measurement $W_S$ using linear regression techniques. In one example, the measured print skew $S_P$ of sheet 118 in each example is represented by the slope of the corresponding curve 260 and 262.

The above described examples using scanner 150 to determine a calibration factor to apply to skew measurements from skew sensors 142 to maintain accurate skew angle measurements of sheet 118 to printhead 102 by skew sensors 142. However, if scanner 150 is skewed relative to printhead 102 (i.e., not parallel with printhead 102), skew measurements $S_P$ of sheet 118 to printhead 102 made by calibration module 152 from the scanned images provided by scanner 150 will vary from an actual print skew by the amount of skew between scanner 150 and printhead 102. As such, if such scanner skew is not accounted for, print skew measurements $S_P$ and, thus, calibration factors determined therefrom, will be inaccurate.

Figure 7A:
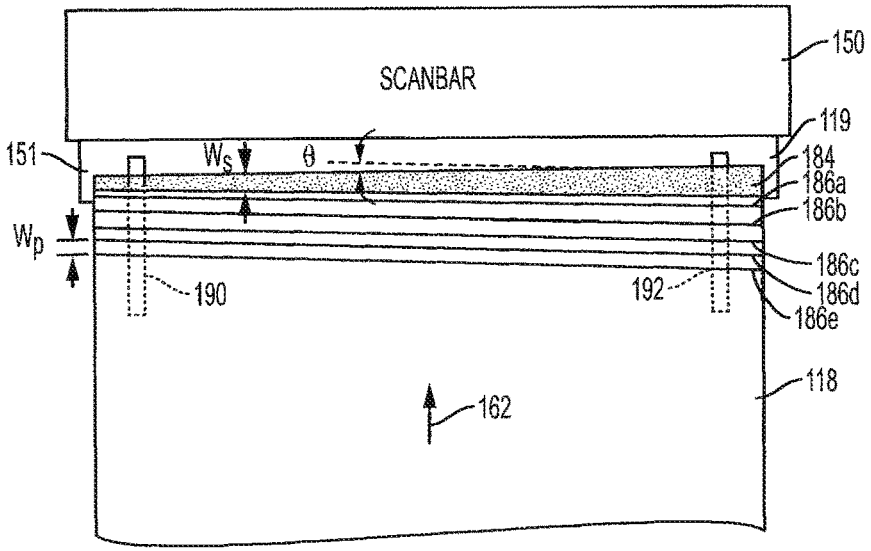
FIG. 7A is a block and schematic diagram generally illustrating portions of a skew sensor calibration unit including a calibration page according to one example.
Figure 7B:
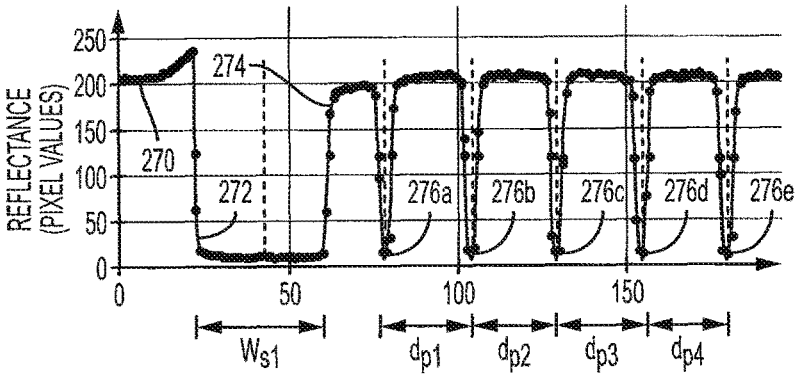
FIG. 7B is a graph is graph of pixel values from a scanned image of a calibration page according to one example.
Figure 7C:
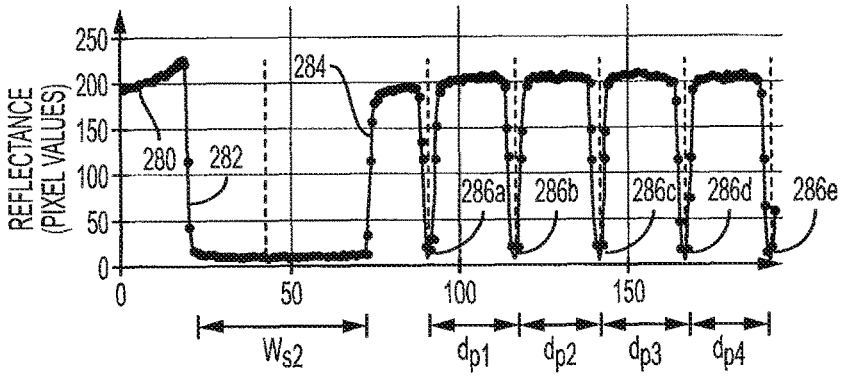
FIG. 7C is a graph is graph of pixel values from a scanned image of a calibration page according to one example.

FIGS. 7A-7C illustrate an example of determining a calibration factor for calibrating skew sensors 142 that compensates for skew between scanner 150 and printhead 102 in accordance with the present disclosure. With reference to FIG. 6A, in addition to bar 184, skew detection pattern 180 includes at least two parallel lines printed on sheet 118. In the example of FIGS. 7A-7C, five parallel lines, indicated as parallel lines 186*a*-186*e*, are printed on sheet 118 by printhead 102. The parallel lines 186*a*-186*e* are printed so as to be spaced apart by a known distance $w_P$. If scanner 150 is perfectly parallel to printhead 102, a distance between parallel lines 186*a*-186*e* as measured by calibration module 152 from a scanned image provided by scanner 150 will be equal to the known distance $w_P$. A difference, $\Delta w_P$, between the known distance distance $w_P$ and the measured distance between parallel lines 186*a*-186*e* (as measured from the scanned image by calibration module 152) is indicative of a skew between scanner 150 and printhead 102. In one example, scanner skew, $S_S$, between scanner 150 and printhead 102 (such as illustrated by angle $\alpha$ in FIG. 7A) is determined by calibration module 152 based on the difference, $\Delta w_P$.

FIG. 7B is a graph illustrating an example of the pixel values of from scanner 150 at ROI 190 in response to the skew detection pattern 180 of FIG. 7A. A portion of the graph at 270 represents reflectance values from bias shoe 151 (in the extended position) prior to sheet 118 reaching scanner 150. A decrease in pixel values at 272 represents a change in reflectance due to leading edge 119 and, thus, bar 184 reaching scanner 150. A rise in pixel values at 274 represents a change in reflectance due to the edge of printed bar 184 passing scanner 150. Each of the dips in pixels values 276*a*-276*e* respectively corresponds to positions of parallel lines 186*a*-186*e* of skew detection pattern 180. $W_{S1}$ represents the width of printed bar 184 at ROI 190, and distances $d_{P1}$-$d_{P4}$ represent the distances between parallel lines 186*a*-186*e*.

Similarly, FIG. 7C is a graph illustrating an example of the pixel values of from scanner 150 at ROI 192 in response to the skew detection pattern 180 of FIG. 6A. A portion of the graph at 280 represents reflectance values from bias shoe 151 (in the extended position) prior to sheet 118 reaching scanner 150. A decrease in pixel values at 282 represents a change in reflectance due to leading edge 119 and, thus, printed bar 184 reaching scanner 150. A rise in pixel values at 284 represents a change in reflectance due to the edge of printed bar 184 passing scanner 150. Each of the dips in pixels values 286*a*-286*e* respectively corresponds to positions of parallel lines 186*a*-186*e* of skew detection pattern 180. $W_{S2}$ represents the width of printed bar 184 at ROI 192, and distances $d_{P1}$-$d_{P4}$ represent the distances between parallel lines 186*a*-186*e*.

As described above, calibration module 152 determines the print skew $S_P$ of sheet 118 relative to printhead 102 from the scanned image based on the determined widths $w_{S1}$, $w_{S2}$ and the predetermined distance $d_R$ between ROI 190 and ROI 192. Calibration module 152 then determines scanner skew $S_S$ between scanner 150 and printbar 102. In one example, to measure the distance between parallel lines 186*a*-186*e* of detection pattern 180, calibration module 152 determines an average of the distances $d_{P1}$-$d_{P4}$ between parallel lines 186*a*-186*e* at each region of interest, in this case ROIs 190 and 192. Calibration module 152 then determines difference, $\Delta w_P$, between the average measured distance and the known distance, $W_P$, and determines scanner skew $S_S$ from difference $\Delta w_P$. Print skew measurement $S_P$ of sheet 118 relative to printhead 102 is then corrected based on the measured scanner skew $S_S$ between scanner 150 and printhead 102 (e.g. scanner skew $S_S$ is subtracted from print skew $S_P$) to generate corrected print skew measurement $S_{PC}$.

In one example, similar to that described above, calibration module 152 generates the calibration factor CF based on top skew measurement $S_T$ and corrected print skew measurement $S_{PC}$ such that when the CF is applied to top skew measurement $S_T$, a corrected or calibrated top skew measurement $S_{TC}$ is generated, where $S_{TC}$ is equal to corrected print skew measurement $S_{PC}$ determined from the scanned image. As described above, deskew controller 146 thereafter applies the calibration factor to top skew measurements $S_T$ from skew sensors 142 to generate calibrated top skew measurements $S_{TC}$, with deskew controller 146 then employing the calibrated top skew measurement $S_{TC}$ from skew sensors 142 to control deskew mechanism 144 to correct the skew of sheets 118.

Although illustrated above as comprising one or more printed lines or bars, it is noted that deskew pattern 180 may comprise any number of features other than lines.

Figure 8:
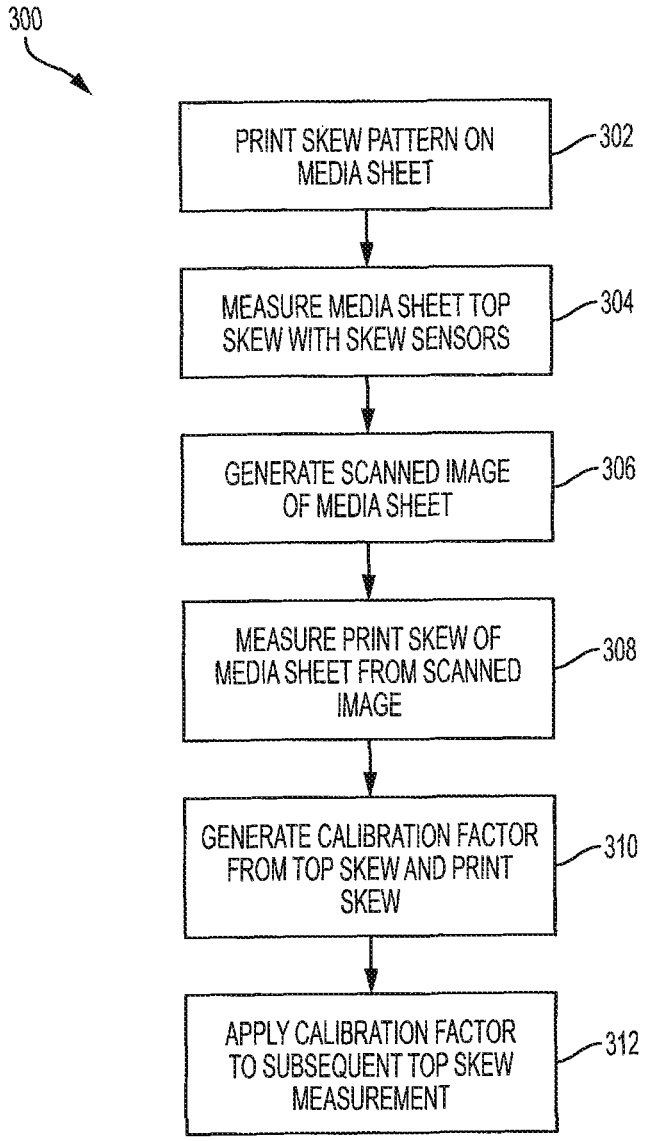
FIG. 8 is a flow diagram illustrating a method for calibrating skew sensors according to one example.

FIG. 8 is a flow diagram generally illustrating a method 300 for calibrating skew sensors according to one example of the present disclosure. At 302, a skew detection pattern is printed on a sheet of print media, such as skew detection pattern 180 on sheet 118 as illustrated by FIG. 2, and the example skew detection patterns illustrated by FIGS. 3A, 4A, 5A and 7A. At 304, a top skew of the sheet of print media is measured by detecting a leading edge of the sheet with a plurality of skew sensors as the sheet moves along a transport path, such as skew sensors 142 detecting a leading edge 119 of print media 118 as it moves along transport path 160 as illustrated by FIG. 2. In other examples, the top skew of the sheet may be measured by the skew sensors prior to a skew detection pattern being printed on the sheet.

A scanned image of the sheet of print media is generated at 306, with the scanned image including the leading edge and the skew detection pattern, such as scanner 150 providing a scanned image of leading edge 119 of sheet 118 and skew detection pattern 180 printed thereon, as illustrated by FIG. 2. At 308, a print skew of the sheet of print media relative to the printhead is measured from the scanned image, such as calibration unit 152 measuring the print skew $S_P$ of sheet 118 by measuring the distance $d_S$ from leading edge 119 to deskew pattern line 182 based on pixel data, as illustrated by FIGS. 3A-3C.

Based on the measured top skew from the skew sensors and on the print skew from the scanned image, at 310, a calibration factor is generated that when applied to the measured top skew provides a calibrated top skew measurement equal to the print skew, such as calibration unit 152 determining calibration factor CF that when applied to top skew $S_T$ based on position signals from skew sensor 42 provides a calibrated top skew $S_{TC}$ equal to print skew $S_P$ based on the scanned image as illustrated by FIGS. 3A-3C, for example. Thereafter, at 312, the calibration factor is applied top skews of subsequent sheet of print media moving along transport as measured by the skew sensors to provide calibrated top skew measurements, such as deskew controller 146 applying the calibration factor CF to top skew measurements $S_T$ based on skew sensors 142 for subsequent sheets of print media 118 so as to provide calibrated top skew measurements $S_{TC}$.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A skew sensor calibration unit comprising:

a scanner providing a scanned image of a sheet as the sheet is conveyed along a transport path, the scanned image including a leading edge of the sheet and a skew detection pattern printed thereon by a printhead; and a calibration module to:

measure a top skew of the sheet based on position signals from a plurality of skew sensors indicating a position of a leading edge of a sheet as the sheet is conveyed along the transport path;

measure an image skew of the sheet relative to the printhead based on the skew detection pattern in the scanned image; and generate a calibration factor that when applied to the measured top skew provides a calibrated top skew that matches the image skew.

2. The skew sensor calibration unit of claim 1, the skew detection pattern comprising a line printed across the sheet crosswise to a transport direction of the sheet along the transport path, and measuring the image skew includes measuring a skew distance from the leading edge to the line at a plurality of locations across the sheet based on pixel values of the scanned image corresponding to the plurality of locations, the plurality of location spaced from one another by predetermined distances and the pixel values representing reflectance values of the sheet.

3. The skew sensor calibration unit of claim 2, the line of the skew detection pattern having a width in the transport direction so as to form a printed bar, the printed bar being printed on the leading edge of the sheet with a trailing edge of the printed bar spaced from the leading edge of the sheet, the skew distance being a distance from the leading edge of the line to the trailing edge of the printed bar.

4. The skew sensor calibration unit of claim 2, the skew detection pattern further including a series of parallel lines printed at a predetermined distance from one another, and the calibration unit to measure a scanner skew relative to the printhead by measuring distances between the parallel lines at the plurality of locations across the sheet based on pixel values of the scanned image corresponding to the plurality of locations and adjusting the measured image skew by subtracting the measured scanner skew therefrom.

5. The skew sensor calibration unit of claim 4, the calibration unit to average the measured distances between the parallel lines at the plurality of locations across the sheet and determine the scanner skew based on comparing the average measured distance to the predetermined distance.

6. The skew sensor calibration unit of claim 1, the scanner comprising a scanbar comprising a single row of pixels extending across the transport path crosswise to the transport direction.

7. A method of operating a printer comprising:

printing a skew detection pattern on a sheet with a printhead;

measuring a top skew of the sheet by detecting a leading edge of the sheet with a plurality of skew sensors as the sheet moves along a transport path;

generating a scanned image of the sheet including the leading edge and the skew detection pattern;

measuring a print skew of the sheet relative to the printhead based on the skew detection pattern in the scanned image;

generating a calibration factor that when applied to the measured top skew provides a calibrated top skew measurement equal to the print skew, applying the calibration factor to measured top skews of subsequent media sheets moving along the transport path to provide calibrated top skew measurements.

8. The method of claim 7, including:

adjusting the position of the sheets based on the corresponding calibrated top skew measurements as the sheets move along the transport so that leading edges of the sheets are aligned with the printhead prior to the sheets reaching the printhead.

9. The method of claim 7, printing the skew pattern including printing a line across the sheet crosswise to a transport direction of the sheet along the transport path.

10. The method of claim 9, measuring the print skew including measuring a skew distance from the leading edge to the line at a plurality of locations across the sheet based on pixel values of the scanned image corresponding to the plurality of locations, the plurality of location spaced from one another by predetermined distances and the pixel values representing reflectance values of the sheet.

11. The method of claim 10, printing the line of the skew detection pattern including print the line with a width in the transport direction so as to form a printed bar, the printed bar being printed on the leading edge of the sheet with a trailing edge of the printed bar spaced from the leading edge of the sheet, the skew distance being a distance from the leading edge of the line to the trailing edge of the printed bar.

12. The method of claim 10, in addition to printing the line, printing the skew detection pattern including printing a series of parallel lines printed at a predetermined distance from one another, the method including:

measuring a scanner skew relative to the printhead by measuring distances between the parallel lines at the plurality of locations across the sheet based on pixel values of the scanned image corresponding to the plurality of locations; and adjusting the measured image skew by subtracting the measured scanner skew therefrom.

13. The method of claim 12, measuring the scanner skew including:

measuring distances between the parallel lines at the plurality of locations across the sheet; and determining the scanner skew based on comparing the average measured distance to the predetermined distance.

14. A printer comprising:

a printhead; and a skew correction unit including:

a plurality of skew sensors disposed across a transport path, each providing a position signal indicating a position of a leading edge of a sheet as the sheet is conveyed along the transport path;

a scanner providing a scanned image of the sheet including the leading edge and a skew detection pattern printed on the sheet by the printhead; and a calibration module to:

measure a top skew of the sheet based on the position signals;

measure a print skew of the sheet relative to the printhead based on the skew detection pattern in the scanned image; and generate a calibration factor that when applied to the measured top skew provides a calibrated top skew that matches the print skew.

15. The printer of claim 14, the skew correction unit including:

a deskew mechanism; and a deskew controller to apply the calibration factor to top skew measurements made by the skew sensors for subsequent sheets to provide calibrated top skew measurements, and to control the deskew mechanism based on the calibrated top skew measurements to adjust the position of the sheets as the sheets move along the transport path so that leading edges of the sheets are aligned with the printhead prior to the sheets reaching the printhead.

* * * * *